US007870729B2

(12) United States Patent
Kauss

(10) Patent No.: US 7,870,729 B2
(45) Date of Patent: Jan. 18, 2011

(54) HYDRAULIC CONTROL DEVICE

(75) Inventor: Wolfgang Kauss, Francheville (FR)

(73) Assignee: Bosch Rexroth AG, Stuttgart (DE)

( * ) Notice: Subject to any disclaimer, the term of this patent is extended or adjusted under 35 U.S.C. 154(b) by 475 days.

(21) Appl. No.: 12/067,081

(22) PCT Filed: Sep. 29, 2006

(86) PCT No.: PCT/EP2006/009480

§ 371 (c)(1),
(2), (4) Date: Mar. 17, 2008

(87) PCT Pub. No.: WO2007/039249

PCT Pub. Date: Apr. 12, 2007

(65) Prior Publication Data

US 2008/0256940 A1 Oct. 23, 2008

(30) Foreign Application Priority Data

Sep. 30, 2005 (DE) ..... 10 2005 047 310

(51) Int. Cl.
*F15B 11/16* (2006.01)
*F15B 13/06* (2006.01)

(52) U.S. Cl. ..... 60/422; 91/516

(58) Field of Classification Search ..... 60/422, 60/426, 452; 91/516
See application file for complete search history.

(56) References Cited

U.S. PATENT DOCUMENTS 4,043,419 A * 8/1977 Larson et al. ..... 60/420
4,663,936 A * 5/1987 Morgan ..... 60/422
5,077,972 A 1/1992 Bianchetta et al.
6,176,083 B1 * 1/2001 Ikari ..... 60/422
6,289,675 B1 * 9/2001 Herfs et al. ..... 60/422
7,204,186 B2 * 4/2007 Mamei et al. ..... 91/516

FOREIGN PATENT DOCUMENTS

| | | |
|---|---|---|
| DE | 43 28 283 | 3/1994 |
| DE | 42 35 709 | 4/1994 |
| DE | 197 03 997 | 8/1998 |
| GB | 2 271 869 | 4/1994 |
| WO | 02/086328 | 10/2002 |

* cited by examiner

*Primary Examiner*—Thomas E Lazo
(74) *Attorney, Agent, or Firm*—Michael J. Striker

(57) ABSTRACT

The invention relates to a hydraulic control device for a priority, first hydraulic consumer and a subordinate, second hydraulic consumer, pressure medium being deliverable to the first or the second consumer via a first or a second metering diaphragm. A pressure scale which allows a constant pressure difference to be adjusted above the first metering diaphragm is mounted upstream from the first metering diaphragm. For this purpose, said pressure scale is provided with a valve piston encompassing a first control edge, by means of which a first flow area between a feeding duct and the first metering diaphragm can be controlled. A second control edge which allows a second flow area to be controlled between the feeding duct and a load signaling line is provided on the valve piston of the first pressure scale.

8 Claims, 5 Drawing Sheets

HYDRAULIC CONTROL DEVICE

BACKGROUND OF THE INVENTION

The present invention relates to a hydraulic control device for a primary hydraulic consumer and a secondary hydraulic consumer.

A hydraulic control circuit of this type is known, e.g., from DE 197 03 997 A1. The pressure medium flows to the two hydraulic consumers via metering orifices. A pressure scale is located upstream of the first metering orifice, which is assigned to the primary, first hydraulic consumer, and a pressure scale is located downstream of the second metering orifice, which is assigned to the secondary, second hydraulic consumer. The pressure scales serve to maintain constant pressure differences via the metering orifices when the quantity of pressure medium delivered is sufficient, independently of the load pressures. As a result, the quantity of pressure medium flowing to a hydraulic consumer depends only on the opening area of the particular metering orifice. The pressure medium source is typically an adjustable hydropump that is controllable as a function of the highest load pressure such that the pressure in a supply line is greater than the highest load pressure, by a certain pressure difference.

With regard for the first consumer, the control circuit corresponds to a load-sensing control (LS control). LS control or LS consumers are typically referred to when hydraulic consumers are controlled to which pressure medium flows via a meter orifice and an upstream pressure scale, and when the pressure scale registers the falling pressure via the particular metering orifice and holds it constant. The pressure scale is acted upon in the closing direction only by the pressure in front of the metering orifice, and it is acted upon in the opening direction only by the load pressure of the particular hydraulic consumer and by a compression spring.

With regard for the second consumer, the control circuit corresponds to an LUDV control. In this case, the pressure scale located downstream of the second metering orifice is acted upon in the opening direction by the pressure after the second metering orifice, and it is acted upon in the closing direction by a control pressure that is present in a rear control space, the control pressure typically corresponding to the highest load pressure of all hydraulic consumers supplied by the same hydropump. If several hydraulic consumers controlled in this manner are actuated simultaneously, the quantities of pressure medium flowing to them are reduced by the same ratio when the quantity of pressure medium delivered by the hydropump is less than the partial quantities of pressure medium demanded. This case is referred to as a control with load-independent flow distribution (LUDV control). The hydraulic consumers controlled in this manner are referred to as LUDV consumers. LUDV control is a special case of load-sensing control (LS control). In that case as well, the highest load pressure is also sensed, and the pressure medium source generates an inlet pressure that is greater than the highest load pressure by a certain amount $\Delta p$.

Publication DE 197 03 997 A1 mentioned above discloses a priority-based switching between the LS consumer and one or more LUDV consumers, in which priority is given to supplying the LS consumers with pressure medium. In addition to the pressure scale of the LS consumer, a priority valve is provided that includes a first connection, which is connected with a line section upstream of the first metering orifice and a second connection connected with the load-sensing line, and the valve element of which is capable of being acted upon—in the direction in which the connection between the first connection and the second connection is opened—by the load pressure of the primary hydraulic consumer, i.e., the LS consumer, and by an additional force. In the closing direction, the valve element is acted upon by pressure upstream of the metering orifice of the LS consumer—in a supply line or between the pressure scale and the first metering orifice. In this manner, it is ensured that priority is given to supplying the LS consumer with pressure medium. In particular, the pressure upstream of the first metering orifice is regulated to a value that is higher than the load pressure of the primary consumer at least by an amount that corresponds to the additional force that acts on the valve element of the primary valve.

SUMMARY OF THE INVENTION

The object of the present invention is to provide—based on the described state of the art—a hydraulic control device that is simpler and more cost-effective to manufacture.

This object is attained by a hydraulic control device according to the present invention.

The present invention relates to a hydraulic control device for a primary hydraulic consumer and one more secondary hydraulic consumers. The primary consumer is controlled by a first metering orifice, upstream of which a (LS) pressure scale is located. The secondary consumer is supplied by a second metering orifice, which is located downstream a pressure scale, in the manner of LUDV control.

The present invention is characterized by the fact that a further control edge is provided on the valve piston of the pressure scale of the primary consumer, which controls the supply of pressure medium from a supply line into a load-sending line. Two control edges are therefore provided on the valve piston of this pressure scale. The first control edge controls the flow of pressure medium supplied to the first metering orifice in the sense of an individual pressure scale for the primary consumer. The second control edge controls a flow area between the inlet and the load-sensing line. As a result, the pressure in the load-sensing line can be increased if the falling pressure difference at the metering orifice of the primary consumer falls below a certain value. This results in an increase in the pressure level upstream of the second metering orifice and, therefore, a reduction in the flow of pressure medium supplied to the secondary consumers. As a result, a sufficient quantity of pressure medium is available to the primary consumer.

The present invention makes clever use of the knowledge that the pressure scale of the primary consumer and the control mechanism of a pressure increase in the load-sending line are controllable using the same pressure signals, in order to realize these two functionalities in a single valve having a simple design. Compared with the conventional means of attaining the object of the present invention, a separate primary valve is not needed, thereby saving material, installation space, and costs. In addition, the inventive control device requires little maintenance, given the smaller number of movable components.

The pressure difference that results at the metering orifice of the primary consumer may be held nearly constant, independently of the operating state, since this pressure difference is determined by the control spring of the pressure scale in every operating state. When the quantity delivered by the pump is adequate and the secondary consumers are load-guiding, the pressure scale of the primary consumer behaves in the manner of an individual pressure scale and throttles the supply of pressure medium in such a manner that a pressure difference determined by the control spring is produced via the metering orifice of the primary consumer. If undersaturation exists, the pressure in the load-sensing line is regulated by the second control edge such that, in turn, the pressure difference at the metering orifice of the primary consumer corresponds to the pressure equivalence of this control spring. In comparison, with traditional control, various springs are provided in the pressure scale and in a primary valve that controls the load-sensing line. To ensure system behavior that may be unambiguously determined, considering the production tolerances, these springs are adjusted to different pressure equivalence values. Under certain circumstances with the conventional system, therefore, a noticeable reduction in pressure occurs at the metering orifice of the primary consumer, e.g., during the transition to undersaturation.

For example, the control edges are located such that a moving direction to open the first flow area corresponds to the moving direction to open the second flow area. This means that the control edges are formed on surfaces of the valve piston that are oriented in the same axial direction. The fact that the two control mechanisms of the pressure scale are actuated in the same direction makes it easier to realize them using a single valve piston.

According to a particularly preferred embodiment, the second flow area is not opened—i.e., pressure medium is not supplied to the load-sensing line—until the hydraulic resistance at the first flow area is nearly minimal. This means that the control mechanism of a pressure increase in the load-sensing line does not engage until the regulation of the flow rate across the pressure scale—that is, through the first area—has reached the upper flow limit of its control range. As a result, an unnecessary increase in the pressure level of the variable-displacement pump and a throttling of the secondary LUDV consumers is prevented for as long as the variable-displacement pump continues to deliver a sufficient quantity of pressure medium. When the control regions of these two control mechanisms adjoin each other in this manner and do not overlap—or they overlap only slightly—it is also possible to always ensure a stable operating state of the inventive hydraulic control device that may be unambiguously assigned to the particular load conditions.

A simple design of the pressure scale of the primary consumer results when it is designed as a gate valve with a valve bore and includes an inlet chamber and two outlet chambers—a first outlet chamber connected with the metering orifice, and a second outlet chamber connected with the load-sensing line.

The complexity of the pressure scale of the primary consumer may be reduced when an end face of the valve piston abuts the first outlet chamber, which is connected with the metering orifice. As a result, the pressure in the outlet chamber acts simultaneously as control pressure on the valve piston, in order to act upon it in the closing direction of the two flow areas.

According to a second, preferred embodiment, a fluid path is formed in the valve piston, which connects a control pressure space formed on an end face of the valve piston with the first outlet chamber. A fluid path of this type is easy to manufacture and is a space-saving way to apply pressure to a control pressure space of the pressure scale upstream of the metering orifice.

The fluid path preferably includes a bore that leads into the circumferential surface of the valve piston and is capable of being moved to overlap with the second outlet chamber. A particularly advantageous design of the pressure scale is obtained, since the fluid path serves simultaneously as a pressure line to the control pressure space and as a flow-through path into the second outlet chamber. Only a small flow area is still required between the inlet line and the load-sensing line, and a quantity of pressure medium supplied to and removed from the control pressure chamber is also small. A fluid path with a small diameter may therefore be used. Since fluid may not be supplied to the load-sensing line until the flow area between the inlet chamber and the first outlet chamber of the pressure scale is already largely open, the fluid pressure in the first outlet chamber largely corresponds to the fluid pressure in the inlet chamber. Fluid may therefore be easily supplied to the second outlet chamber from a region in the first outlet chamber, instead of directly from the inlet chamber, and the simple valve design described may be attained.

As an alternative, a recess is provided in the valve piston that may be moved to overlap simultaneously with the inlet chamber and the second outlet chamber. As a result, the first flow area and the second flow area may be designed independently of each other, if necessary.

The present invention and its advantages are described in greater detail below with reference to the exemplary embodiment presented in the figures.

DESCRIPTION OF THE PREFERRED EMBODIMENT

Figure 1:
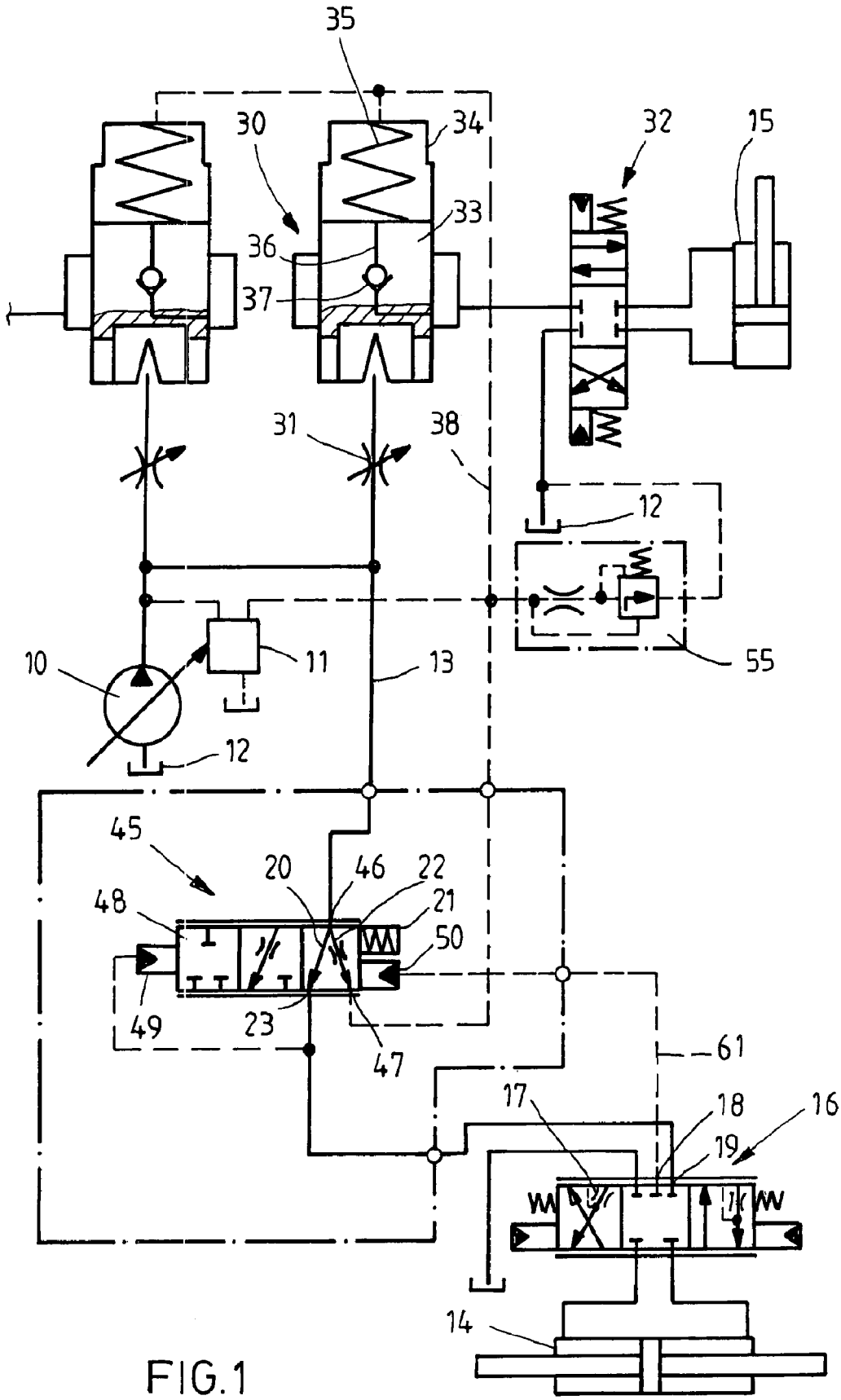
FIG. 1 shows a circuit diagram of a hydraulic control device with a primary consumer and a control valve that controls the flow of pressure medium to the primary consumer and the supply of pressure medium to a load-sensing line.

According to FIG. 1, a variable-displacement pump 10 with a displacement control 11 suctions pressure medium out of a tank 12 and supplies it to a system of supply lines. Via the supply lines, a first hydraulic consumer 14, which is designed as a synchronous cylinder, and at least one second hydraulic consumer 15, which is a differential cylinder, are supplied with pressure medium. The direction and speed of the synchronous cylinder 14 are determined via actuation of a 4/3-proportional directional control valve 16, the valve spool of which is centered via a spring in a central position, in which the four working connections and one control connection 18 of directional control valve 16 are blocked. When the valve spool is displaced from its central position in one direction or the other, a metering orifice 17 is opened to an extent that depends on the displacement of the valve spool. Downstream of the metering orifice, control connection 18 is connected with the approach to synchronous cylinder 14.

A control valve 45 with the function of a 2-way pressure scale is installed between a supply line 13 and a supply connection 19 of directional control valve 16. Accordingly, control valve 45 controls the flow area of a fluid connection 20 between its inlet 46 and one of its outlets 23, i.e., between supply line 13 and supply connection 19 of directional control valve 16. Valve piston 48 of control valve 45 is acted upon, in the direction of closing connection 20, by pressure upstream of a metering orifice 17 and, in the direction of closing, via a control line 61 by pressure in control connection 18 of directional control valve 16, i.e, by the load pressure of synchronous cylinder 14, and by a control spring 21. The force of control spring 21 is designed such that it is equivalent to a pressure difference of, e.g., 15 bar above metering orifice 17.

While control valve 45 assigned to first hydraulic consumer 14 is therefore located upstream of first metering orifice 17, second pressure scale 30 assigned to second hydraulic consumer 15 is located downstream of a second metering orifice 31. To control the direction of differential cylinder 15, a directional control valve 32 is located between second pressure scale 30 and the differential cylinder, via which pressure does not drop noticeably when differential cylinder 15 is actuated, compared with the drop in pressure at metering orifice 31. Metering orifice 31 and the control grooves required to control direction are designed on the same valve spool in a known manner, so that direction and speed are automatically controlled jointly. Control piston 33 of pressure scale 30 is acted upon—in the direction of opening the connection between metering orifice 31 and directional control valve 32—by the pressure after metering orifice, and, in the direction of closing the connection, by a control pressure that exists in a rear control pressure space 34, and by a weak compression spring 35, which is equivalent to a pressure of, e.g., only 0.5 bar. The front side of control piston 33 is connected via a channel 36 extending in the control piston with control pressure space 34. A non-return valve 37 that is open toward the control pressure space is located in channel 36.

In parallel with metering orifice 31, pressure scale 30, and directional control valve 32 for second hydraulic consumer 15, further metering orifices, pressure scales, and directional control valves for further hydraulic consumers may be connected to the system of supply lines 13. Control pressure spaces 34 of all pressure scales 30 are connected with each other, so that the same pressure forms in these control pressure spaces. When a second hydraulic consumer is actuated, control pistons 33 of the pressure scales attempt to move into a position in which a pressure occurs on their front side that is higher than the pressure in control pressure spaces 34 only by the pressure difference equivalent to the force of compression spring 35.

Disregarding first hydraulic consumer 14 entirely, the highest load pressure of all actuated, second hydraulic consumers 15 is transferred to control pressure spaces 34 via channels 36 and non-return valves 37. Control pressure spaces 34 are connected to a load-sensing line 38 that leads to displacement control 11 of pump 10. Load-sensing line 38 is also connected with tank 12, via a current control 55. These current controls relieve the pressure on load-sensing line 38 when none of the hydraulic consumers is actuated.

Variable displacement pumps and related controllers are known in general and are readily available on the market. It is therefore not necessary to discuss them in greater detail. It should merely be noted that the pump control serves to adjust a pressure in supply line 13 that is higher than the pressure in load-sensing line 38 by a pressure difference Δp equivalent to the force of a control spring. Pressure difference Δp is, e.g., 20 bar, and is therefore higher than pressure difference of 15 bar, which is equivalent to the force of control spring 21 of control valve 45.

First hydraulic consumer 14 should be supplied with pressure medium with priority over second hydraulic consumer 15. A second controllable connection 22 is provided in control valve 45 for this purpose. Connection 22 is designed as an orifice with a proportionally controllable flow area between inlet 46 and an outlet 47. Outlet 47 is connected with load-sensing line 38.

For the second fluid connection 22 controlled by it, valve piston 48 of control valve 45 is acted upon, in the direction of closing, by a pressure upstream of metering orifice 17 and, in the direction of opening, by the load pressure of primary consumer 14 applied via control line 61, and by control spring 21.

Figure 2:
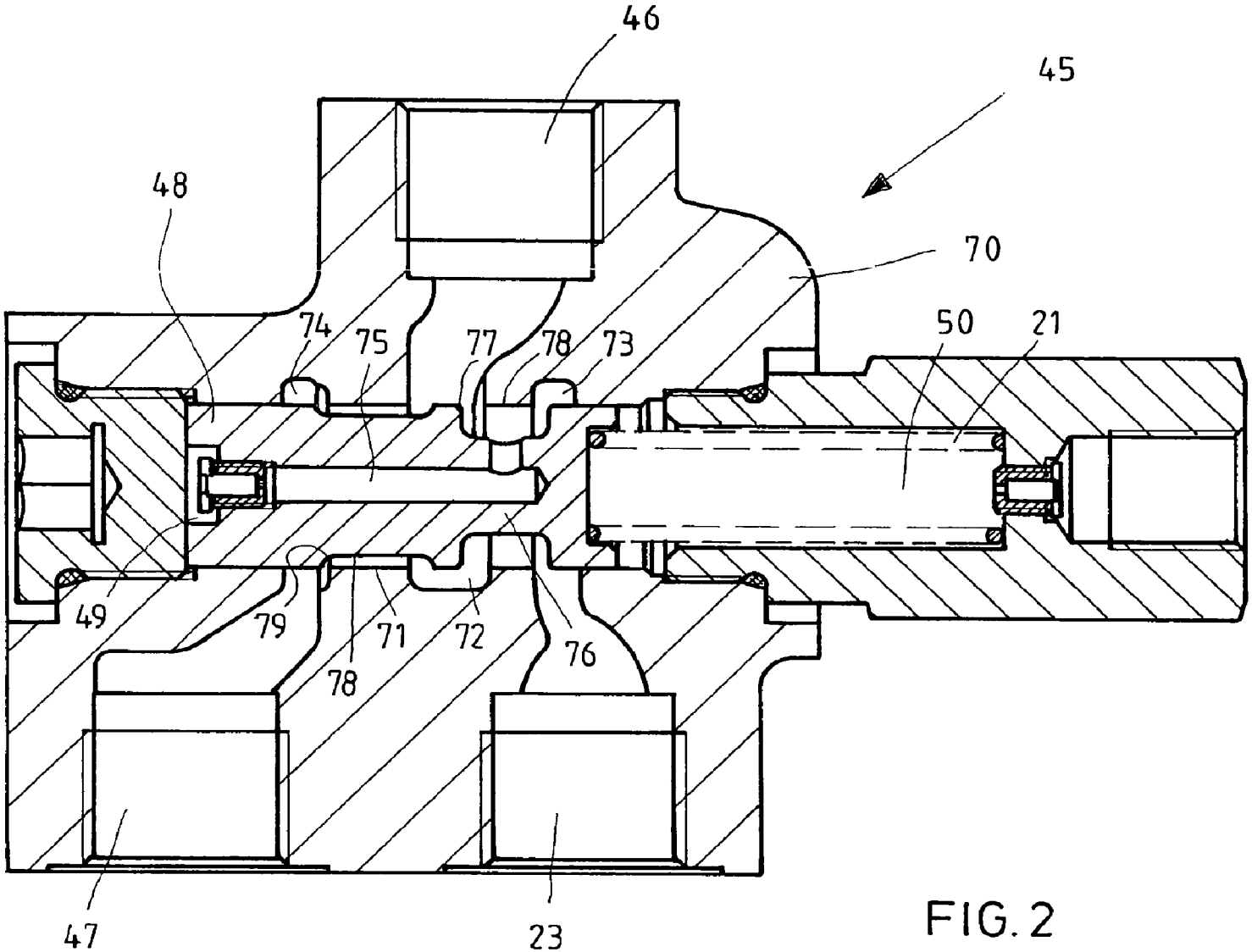
FIG. 2 is a sectional image of the control valve shown in FIG. 1.

Control valve 45 is shown in greater detail in FIG. 2. A valve bore 71 is provided in valve housing 70. Valve piston 48 is displaceably supported in this bore. The valve bore is abutted by an inlet chamber 72 and two outlet chambers 73 and 74. The inlet chamber is connected with connection 46, which is designed as a bore, and, therefore, with supply line 13. Outlet chamber 73 is connected with outlet 23, i.e., with metering orifice 17. Outlet chamber 74 leads into load-sensing line 38, via connection 47.

Controllable fluid connection 20 is established via a radially recessed section 76 of valve piston 48. Control edge 77 is formed on valve piston 48, on a step located in the direction of inlet chamber 72. Control edge 77 bounds a first flow section between itself and a housing segment 78, which is formed between inlet chamber 72 and outlet chamber 73.

Fluid connection 22 is formed by a recess 78 in the circumferential surface of valve piston 48. Recess 78 may be, e.g., an axial groove or a radial step of the valve piston. A control edge 79, which bounds recess 78 in the direction of outlet chamber 74, forms a second controllable and closable flow area with outlet chamber 74.

A control pressure space 50 is connected to control line 61, which directs the load pressure of primary consumer 14. The pressure in control pressure space 50 acts on valve piston 48 in the direction of opening of fluid connections 20 and 22. In addition, the force of control spring 21 on valve piston 48 acts in the direction of opening. The pressure present in control pressure space 49 acts in the closing direction. Control pressure space 49 is fluidly connected via a fluid channel 75 formed in valve piston 48 with radially recessed section 76 and, therefore, with outlet chamber 73.

The mode of operation of the inventive control device will now be explained with reference to FIGS. 1 and 2. An equilibrium of forces involving the following force and pressure components sets in at valve piston 48 of control valve 45:

$$p_{LS}+p_{21}=p_{38}+\Delta p\ \Delta p_{DW} \qquad \text{(Equation 1)},$$

in which $p_{LS}$ is the load pressure of primary consumer 14, $p_{21}$ is the pressure equivalent of the force of control spring 21, $p_{38}$ is the load pressure in load-sensing line 38, Δp is the control pressure difference of pump displacement control 11, and $\Delta p_{DW}$ is the pressure that is falling at control edge 77 of connection 22.

Control edge 79 is positioned such that connection 22 does not open until the flow area at control edge 77 is nearly at a maximum, i.e., when pressure drop $\Delta p_{DW}$ at control edge 77 has reached a value $\Delta p_{DW*}$ that is nearly a minimum. Value $\Delta p_{DW*}$ depends on the flow rate at control edge 77, however.

If the flow of pressure medium conveyed by the pump is sufficient to supply all of the consumers, control pressure difference Δp remains constant at the value set by the control spring of pump displacement control 11, e.g, 20 bar.

As long as the secondary consumers are load-guiding, that is, as long as the pressure in supply line 13 is greater than the sum of the load pressure of primary consumer 14 and the pressure equivalence of control spring 21, a pressure drop $\Delta p_{DW}$ is generated via control edge 77 to regulate the supply to the primary consumer. The pressure drop $\Delta p_{DW}$ results in a throttling of excess pressure present in supply line 13 with respect to primary consumer 14. Pressure $P_{38}$ in the load-sensing line corresponds to the highest load pressure of the secondary consumer, which is referred to below as $p_{LUDV}$.

With a load pressure of the primary consumer of $$p_{LS}>(p_{LUDV}+\Delta p)-p_{21}--\Delta p_{DW*} \quad \text{(Equation 2)},$$

in which $(p_{LUDV}+\Delta p)$ is the supply pressure that may be generated by secondary consumer 15, the control mechanism of a throttling at first control edge 77 is exhausted, and the associated flow area is completely open.

Therefore, when the supply pressure $(p_{38}+\Delta p)$ falls above or below the value $p_{LS}+P_{21}+\Delta p_{DW*}$, second control edge 79 opens the flow area of connection 22. As a result, pressure $p_{38}$ in load-sensing line 38 increases to values greater than $P_{LUDV}$. If the pressure $(p_{38}+\Delta p)$ present in supply line 13 was previously dependent only on load pressure $P_{LUDV}$ of the secondary consumers, the supply line pressure $(p_{38}+\Delta p)$ is now determined by load pressure $p_{LS}$ of primary consumer 14. Supply line pressure $(P_{38}+\Delta p)$ is controlled using control edge 79 and the feedback via displacement control 11. Equation 1 directly results in the dependency $$(p_{38}+\Delta p)=p_{LS}+p_{21}'+\Delta p_{DW*} \quad \text{(Equation 3)},$$

when one considers that control spring 21 is loaded less when regulation is carried out at control edge 79 than when regulation is carried out at control edge 77, i.e., it has a slightly less pressure equivalence $p_{21}'$ than $p_{21}$, and when $\Delta p_{DW*}$ is assumed to be a slight pressure drop at the flow area, which is nearly completely open and is bounded by control edge 77. Essentially, the pressure in supply line 13 is regulated to a value that is higher than the load pressure of the primary consumer 14 by pressure equivalence $p_{21}'$ of control spring 21.

When the flow of pressure medium conveyed by pump 10 does not suffice to supply all consumers, $\Delta p$ may no longer be regarded as constant. The control capacity of pump 10 and its displacement control 11 are exhausted, and the pressure in supply line 13 drops. As before, connection 22 opens when the supply line pressure $(p_{38}+\Delta p)$ drops to $p_{LS}+p_{21}+\Delta p_{DW*}$. This results in an increase of the pressure present in load-sensing line 38. As a result, the pressure between metering orifice 31 and pressure scale 30 of secondary consumer also increases. The pressure difference that is present at metering orifice 31 is reduced and, therefore, the flow of pressure medium that may be supplied to the secondary consumer also decreases. If necessary, when control pressure difference $\Delta p$ has dropped accordingly, the pressure in load-sensing line 38 may increase to the supply pressure $(p_{38}+\Delta p)$ and completely halt the supply to secondary consumer 15, via pressure scale 30. It is also possible to limit several secondary consumers 15 in this manner. Via this mechanism of throttling secondary consumer 15, the supply pressure $(p_{38}+\Delta p)$ is regulated per equation 3, to a value that is essentially higher than the load pressure of the primary consumer 14 by pressure equivalence $p_{21}'$ of control spring 21.

In every case, a reliable supply of primary consumer 14 is therefore ensured such that a pressure difference that corresponds to pressure equivalence $p_{21}$ or $p_{21}'$ of control spring 21 is present above metering orifice 17.

Figures 3A, 3B:
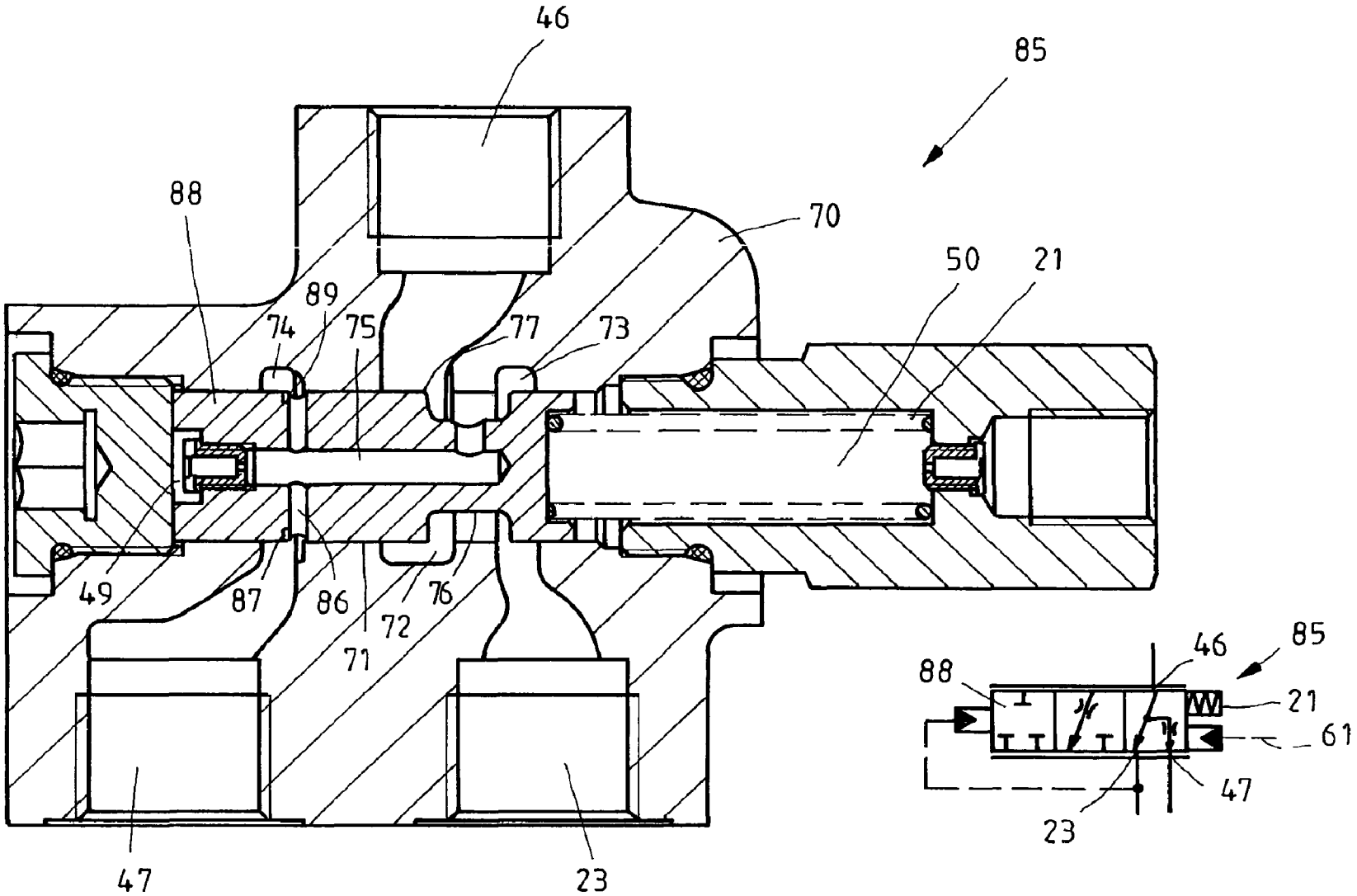
FIG. 3A is a sectional image of the control valve shown in FIG. 1, in an alternative design.
FIG. 3B is a symbolic depiction of the control valve shown in FIG. 3A.

FIG. 3A shows a control valve 85, which is a modified design of control valve 45. A symbolic depiction of control valve 85 is shown in FIG. 3B. The only difference between control valve 85 and control valve 45 is that control valve 85 has valve piston 88. Similar to valve piston 48, valve piston 88 includes a radially recessed piston section 76. A fluid channel 75 extends out of this piston section and leads into control pressure space 49 located on an end face of valve piston 88. In contrast to valve piston 48, there is no recess in the circumferential surface of the piston with which inlet chamber 72 may be connected directly with outlet chamber 74. Instead, a bore 86 is formed perpendicularly to the axis of valve piston 88. Bore 86 leads into fluid channel 75. Together with a fine control groove 87, bore 86 forms a control edge 89 for controlling a flow area at outlet chamber 74. It should be noted that this opening area formed between control edge 89 and valve housing 70 does not open until the hydraulic resistance or pressure drop $\Delta p_{DW}$ at control edge 77 has already reached a value $\Delta p_{DW*}$ close to the minimum value. The pressure of the pressure medium, which is supplied by radially recessed piston section 76 via fluid path 75 when control edge 89 is opened therefore approximately corresponds to the pressure in inlet connection 46. As a result the pressure in load-sensing line 38 may be increased nearly to the supply fine pressure that is present at inlet connection 46.

Figure 4:
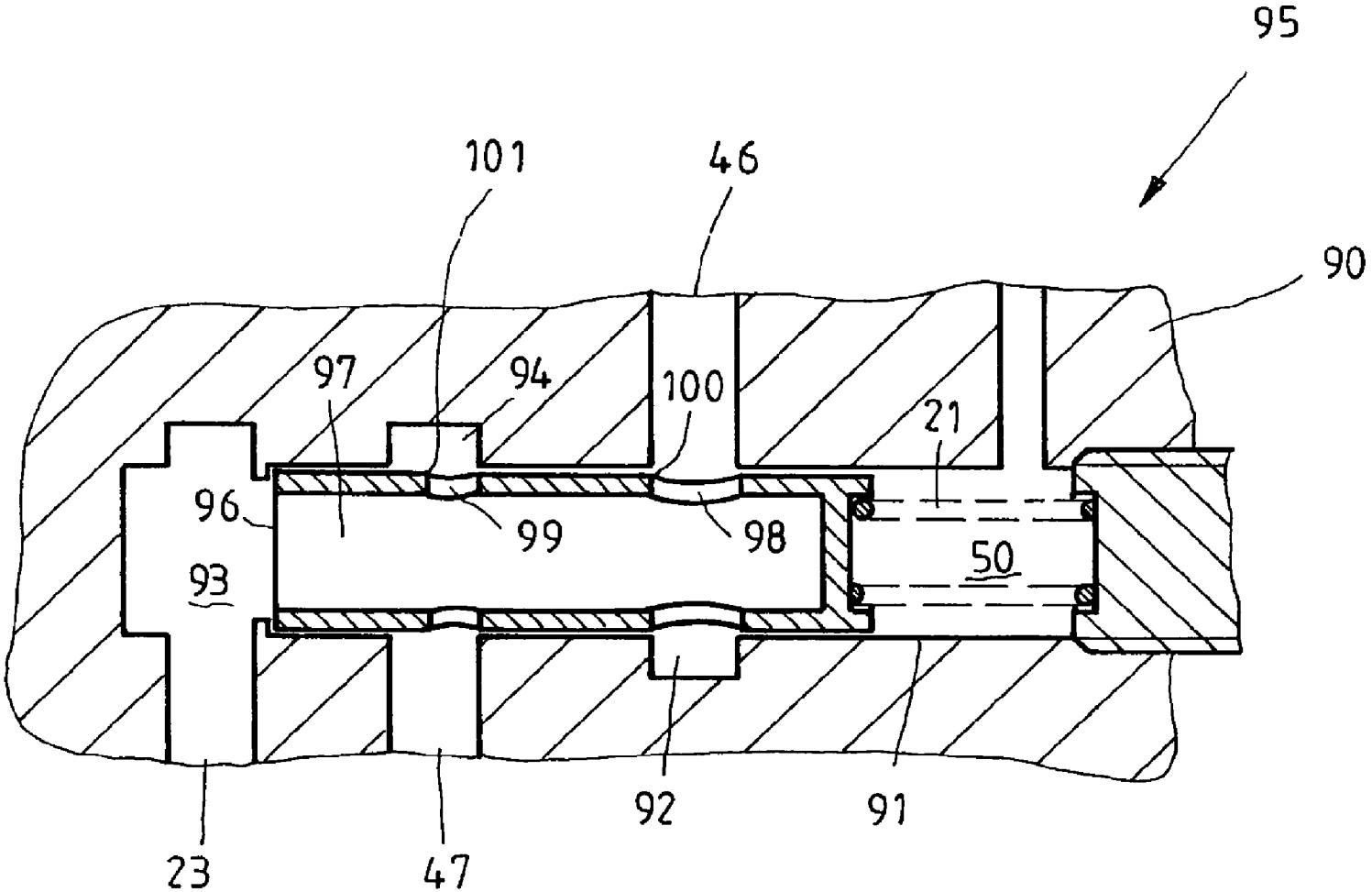
FIG. 4 is a schematic diagram of a further design of the control valve shown in FIG. 1.

A further design of a control valve 95 that may be used in place of control valve 45 or 85 is shown in FIG. 4. The symbolic depiction of control valve 95 corresponds to that shown in FIG. 3B. A valve bore 91 is provided in valve housing 90 of control valve 95. An inlet chamber 92 and two outlet chambers 93 and 94 are located at valve bore 91. Chambers 92, 93 and 94 are fluidly connected with related connections 46, 47 and 23, as shown in FIG. 4. A cylindrical valve piston 96 is movably guided in valve bore 91. Valve piston 96 includes an axially extending blind hole 97 that is open in the direction of outlet chamber 93. From circumferential surface of valve piston 96, two radially extending bores 98 and 99 extend toward blind hole 97.

Bore 98 may be moved to overlap with inlet chamber 92. As a result, a fluid connection is created from inlet connection 46 via bore 98, blind hole 97, outlet chamber 93, and outlet connection 23. Control edge 100, which plays a decisive role in the control of the flow area of this connection, is the edge of bore 98 on the circumferential side. A fluid connection from inlet connection 46 to outlet connection 47 is created via bore 98, blind hole 97, bore 99, and outlet chamber 94. Control edge 101, which is decisive for this, is the edge of bore 99 on the circumferential side. Bore 99 is located such that it does not overlap with outlet chamber 94 until the flow area controlled at bore 99 results in a slight hydraulic resistance/pressure drop $\Delta p_{DW*}$. As a result, the pressure in load-sensing line 38 may be increased nearly to the inlet pressure present at inlet connection 46.

On an end face of valve piston 96 facing away from blind hole 97, valve piston 96 bounds a control pressure space 50 formed in valve housing 90. It is connected to control line 61, which guides the load pressure of primary consumer 14. The pressure in control pressure space 50 acts in the direction of opening of the connections controlled by bores 98 and 99. In addition, control spring 21 located in control pressure space 50 acts in the opening direction. In the closing direction, valve piston 96 is acted upon directly by the pressure in outlet chamber 93, since valve piston 96 abuts outlet chamber 93 with its end face that leads into blind hole 97. With this embodiment of control valve 95, a very low pressure drop $\Delta p_{DW*}$ at bore 98 may be attained, and by locating outlet chamber 93 on the end-face end of valve piston 96, it is not necessary design a separate control chamber or a control line that leads thereto, internally or externally.

Figure 5:
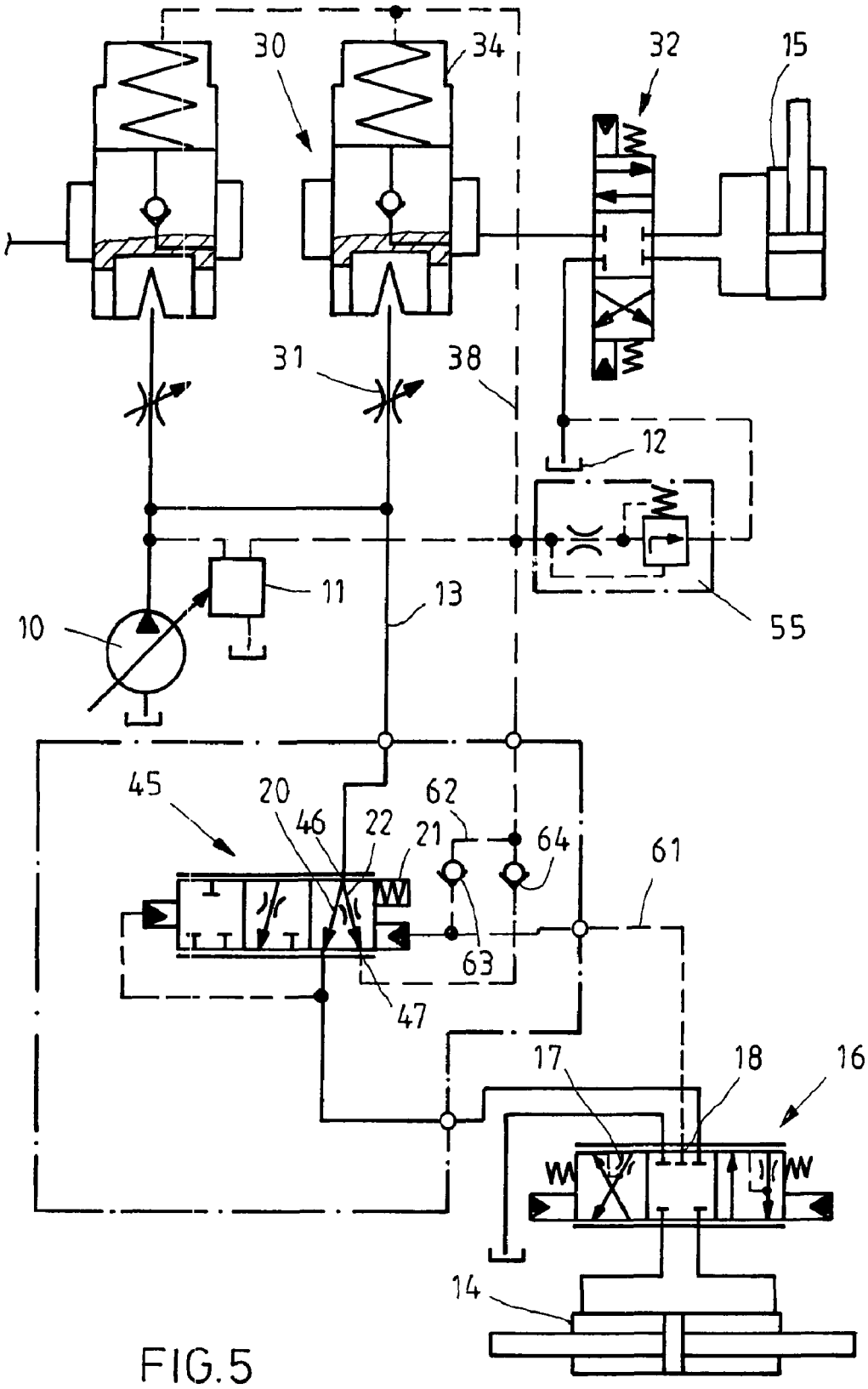
FIG. 5 is a circuit diagram of a hydraulic control device, comparable to FIG. 1, with a by-pass line for indicating a load pressure of the primary consumer to the load-sensing line.

FIG. 5 shows a further embodiment of the inventive hydraulic control device. The embodiment shown in FIG. 5 is largely equivalent to the design shown in FIG. 1. The difference from the embodiment shown in FIG. 1 is that control line 61 that leads from control connection 18 of directional control valve 16 to control valve 45 is also connected with load-sensing line 38, via a non-return valve 63 located in a by-pass line 62. Non-return valve 63 blocks from load-sensing line 38 toward channel 61, i.e., toward control connection 18 of directional control valve 16. In addition, a non-return valve 64 is also located between second connection 47 of control valve 45 and load-sensing line 38. Non-return valve 64 blocks toward connection 47.

With the embodiment shown in FIG. 1, as described above, even when a sufficient quantity of pressure medium is conveyed, a change takes place in the control mechanism of control valve 45 when load pressure $p_{LS}$ of primary consumer 14 exceeds the supply pressure ($P_{LUDV}+\Delta p$) specified by the secondary consumers, minus pressure equivalent $p_{21}$ of control spring 21 (pressure drop $\Delta p_{DW*}$ at control edge 77 is negligibly small). When the primary consumer becomes load-guiding in this sense, the control valve loses its functionality as an LS pressure scale. This is replaced by the mechanism of controlling the pressure in load-sensing line 38.

With the embodiment shown in FIG. 5, when a sufficient quantity of pressure medium is pumped, and given a load-guiding, primary hydraulic consumer 14, the load pressure of this hydraulic consumer is directed via non-return valve 63 into load-sensing line 38. The pressure in supply line 13 is therefore higher than the load pressure of hydraulic consumer 14 by control pressure difference $\Delta p$ of variable-displacement pump 10. In this case, control valve 45 has the function of an LS pressure scale and throttles the flow of pressure medium directed to metering orifice via first control edge 77. The pressure difference present above pressure scale 17 therefore corresponds to pressure equivalent $p_{21}$ of control spring 21.

Pressure medium is not directed to load-sensing line 38 via connection 22 until—when undersaturation occurs—the pressure ($p_{38}+\Delta p$) in supply line 13 has dropped to the sum of load pressure $P_{LS}$ of hydraulic consumer 14, pressure equivalent $P_{21}$ of control spring 21, and a slight pressure drop $\Delta p_{DW*}$ at control edge 77. The pressure drop via metering orifice 17 is basically not reduced, because, as undersaturation continues, pressure $p_{38}$ in load-sensing line 38 via control valve 45 increases and, as a result, pressure scales 30 of LUDV consumers 15 are displaced in the closing direction.

Non-return valve 64 prevents pressure medium from flowing from hydraulic consumer 14 via non-return valve 63 into the system of supply lines, provided that the pressure in the supply lines is not yet above the load pressure, e.g., at the beginning of an actuation.

Non-return valve 64 may be eliminated when connection 47 of control valve 45 is connected with non-return valve 63 in such a manner that non-return valve 63 blocks toward connection 47.

List of Reference Numerals

10 Variable-displacement pump
11 Displacement control
12 Tank
13 Supply line
14 Synchronous cylinder
15 Differential cylinder
16 4/3-way proportional directional control valve
17 Metering orifice
18 Control connection
19 Supply connection
20 Fluid connection
21 Control spring
20 Fluid connection
23 Outlet
30 Pressure scale
31 Metering orifice
32 Directional control valve
33 Regulating piston
34 Control pressure space
35 Compression spring
36 Channel
37 Non-return valve
38 Load-signalling line
45 Control valve
46 Inlet
47 Outlet
48 Valve piston
49 Control pressure space
50 Control pressure space
55 Current control
61 Control line
62 Bypass line
63 Non-return valve
64 Non-return valve
70 Valve housing
71 Valve bore
72 Inlet chamber
73 Outlet chamber
74 Outlet chamber
75 Fluid channel
76 Recessed piston section
77 Control edge
78 Recess
79 Control edge
85 Control valve
86 Bore
87 Fine-control groove
88 Valve piston
89 Control edge
90 Housing
91 Valve bore
92 Inlet chamber
93 Outlet chamber
94 Outlet chamber
95 Control valve
96 Valve piston
97 Blind hole
98 Radial bore
99 Radial bore
100 Control edge
101 Control edge

What is claimed is:

1. A hydraulic control device for a primary, first hydraulic consumer (14) and a secondary, second hydraulic consumer (15) with a first metering orifice (17), via which the pressure medium is suppliable to the first hydraulic consumer (14), with a pressure scale (45) installed upstream of the first metering orifice (17), via which a constant pressure difference is adjustable using the first metering orifice (17) and which includes, for this purpose, a valve piston (48) with a first control edge (77), with which a first flow area between a supply line (13) and the first metering orifice (17) is controllable, with a second metering orifice (31), via which the pressure medium may be supplied to the second hydraulic consumer (15), and downstream of which a second pressure scale (30) located, which, in the closing direction, may be acted upon by a control pressure present in a control space (34) and which, in the opening direction, may be acted upon by pressure after the second metering orifice (31), with a pressure medium source (10) that delivers variable quantities, the pressure medium source (10) being controllable as a function of the highest load pressure of the actuated hydraulic consumer (14, 15) in a manner such that the pressure in the supply line (13) is higher than the highest load pressure by a certain pressure difference, and with a load-signalling line (38) that may be acted upon with the load pressure of the second hydraulic consumer (15) or a pressure derived therefrom, and which is connected with the control space (34) of the second pressure scale (30) and with a control device (11) of the pressure medium source (10), wherein a second control edge (79) is provided on the valve piston (48) of the first pressure scale (45), with which a second flow area located between the supply line (13) and the load-signalling line (38) is controllable.

2. The hydraulic control device as recited in claim 1, wherein the first control edge (77) and the second control edge (79) are positioned such that a moving direction of the valve piston (48) to open the first flow area corresponds to a moving direction of the valve piston (48) to open the second flow area.

3. The hydraulic control device as recited in claim 1, wherein the second flow area is not opened until the hydraulic resistance at the first flow area is nearly minimal.

4. The hydraulic control device as recited in claim 1, wherein a valve bore (71) is formed in a valve housing (70) of the pressure scale (45), in which the valve piston (48) is movably guided, and the following are connected to the valve bore (71): An inlet chamber (72), a first outlet chamber (73), which is fluidly connected with the first metering orifice, and a second outlet chamber (74), which is fluidly connected with the load-signalling line (38).

5. The hydraulic control device as recited in claim 4, wherein the valve piston (96) abuts the first outlet chamber (93) with an end face.

6. The hydraulic control device as recited in claim 4, wherein a fluid path (75) is formed in the valve piston (48; 88) and connects a control pressure space (49) adjacent to an end face of the valve piston (48; 88) with the first outlet chamber (73).

7. The hydraulic control device as recited in claim 6, wherein the fluid path (75) includes a bore (86) that leads into the circumferential surface of the valve piston (88), it being possible to move the bore (86) such that it overlaps with the second outlet chamber (74).

8. The hydraulic control device as recited in claim 4, wherein the valve piston (48) includes a recess (78), which may be moved such that it simultaneously overlaps with the inlet chamber (72) and the second outlet chamber (74).

* * * * *